United States Patent [19]

Good et al.

[11] Patent Number: 4,687,194

[45] Date of Patent: Aug. 18, 1987

[54] AUTOMATICALLY-ADJUSTABLE UNEVEN PARALLEL BARS FOR GYMNASTICS

[76] Inventors: Warren T. Good, 8035 SW. 8th Ave., Portland, Oreg. 97219; Jacob E. Vilhauer, Jr., 3325 SW. 44th, Portland, Oreg. 97221

[21] Appl. No.: 797,146

[22] Filed: Nov. 12, 1985

[51] Int. Cl.[4] ..... A63B 3/00

[52] U.S. Cl. ..... 272/63; 272/DIG. 4

[58] Field of Search ..... 272/63, 109, 62, 103, 272/112, DIG. 4

[56] References Cited

U.S. PATENT DOCUMENTS 3,534,955 10/1970 Weeland ..... 272/63
4,402,501 9/1983 Lohman ..... 272/63
4,491,314 1/1985 Belyavsky et al. ..... 272/63
4,555,107 11/1985 Otto ..... 272/63

*Primary Examiner*—Richard J. Apley
*Assistant Examiner*—J. Welsh
*Attorney, Agent, or Firm*—Chernoff, Vilhauer, McClung & Stenzel

[57] ABSTRACT

Uneven parallel bars for gymnastics have motors for variably establishing not only the spacing between the handrails but also different predetermined vertical heights of the handrails relative to the floor surface. A single motor at each end of the handrails performs all of the adjustments without requiring any movement or adjustment of the tensioning cables. The motors are able to adjust the handrails not only prior to a gymnast's performance, but also during the performance if desired.

17 Claims, 2 Drawing Figures

AUTOMATICALLY-ADJUSTABLE UNEVEN PARALLEL BARS FOR GYMNASTICS

BACKGROUND OF THE INVENTION

The present invention is directed to improvements in means for operating uneven parallel bars employed in women's gymnastics.

Conventional uneven parallel bars provide for three adjustments in the respective positions of the two parallel handrails, i.e. variation of the spacing between the handrails by adjustment of a pair of transverse struts extending between the handrails, and adjustment of the respective heights of the upper and lower handrails relative to the floor by adjustment of a pair of telescopic vertical supports at each end of the handrails. These adjustments, particularly the spacing between the handrails, vary from gymnast to gymnast due to differences in height and body proportions. It has long been recognized that, in practice and competition, the need to perform these adjustments for each gymnast consumes excessive time and effort.

To overcome this problem, appartus for automatic adjustment of the spacing between the handrails has been developed as shown, for example, in U.S. Pat. Nos. 4,402,501 and 4,491,314. However, such spacing adjustment apparatus has certain shortcomings. First, no provision is made for automatic control of the other two adjustments, i.e. the vertical heights of the two handrails relative to the floor surface. In addition, such adjustment of the spacing between the handrails requires movement of the tensioning cables which brace the apparatus against horizontal displacement, thereby requiring either elaborate cable tension control apparatus as described in U.S. Pat. No. 4,491,314, or manual adjustment of the cables as mentioned in U.S. Pat. No. 4,402, 501. Such systems do not, therefore, provide a particularly complete or feasible solution to the problems involved in performing all of the necessary adjustments prior to each gymnast's performance.

When gymnasts progress to a relatively high skill level, where the emphasis is on giant swings and similar maneuvers requiring maximum spacing of the handrails from each other, many other types of maneuvers requiring closer spacing of the handrails are precluded. It is believed that greater variety and beauty in uneven bar performances by highly skilled gymnasts would result if the limitations of the bar apparatus, which force the gymnast to choose between types of maneuvers, could be overcome.

SUMMARY OF THE INVENTION

The present invention is principally directed to a simple apparatus for automatically varying all three handrail adjustments of the uneven bars quickly and easily between performances by different gymnasts, without any resultant movement of the tensioning cables.

As a secondary optional objective the invention is further directed to an uneven bar structure capable of safely and quickly changing handrail spacing, and preferably the other adjustments as well, in midperformance by the gymnast. Of course, the usefulness of this secondary objective depends upon the approval of those who regulate the sport of gymnastics.

To accomplish the foregoing principal objective, the present invention provides a motor-actuated structure not only capable of automatically varying the spacing between the handrails, but also capable of automatically establishing different predetermined vertical heights of the two handrails relative to the floor surface. The scope of the invention, in its broadest sense, contemplates many different ways of performing these functions including, for example, separte motors for each of the three conventional adjustments. However, the preferable appartus is a lightweight, simple and relatively inexpensive structure utilizing only a single motor on each end of the handrails to provide all three adjustments. For ultimate simplicity, the magnitudes of the handrail heights and spacing are preferably interdependent upon one another, although provision is also made for independence of each adjustment from the others if necessary. Moreover, because the handrail spacing adjustment is accomplished by the present invention differently from any prior art apparatus, variation in such spacing does not require any movement or adjustment whatsoever of the tensioning cables.

The conditional secondary objective of the present invention, i.e. enabling the adjustments of the uneven bars to be varied in midperformance by the gymnast, is satisfied by making the motorized automatic adjustment structure programmable so as to perform multiple predetermined adjustments of the handrails in a predetermined sequence.

The foregoing and other objectives, features, and advantages of the invention will be more readily understood upon consideration of the following detailed description of the invention, taken in conjunction with the accompanying drawings.

DESCRIPTION OF THE PREFERRED EMBODIMENT

Figure 1:
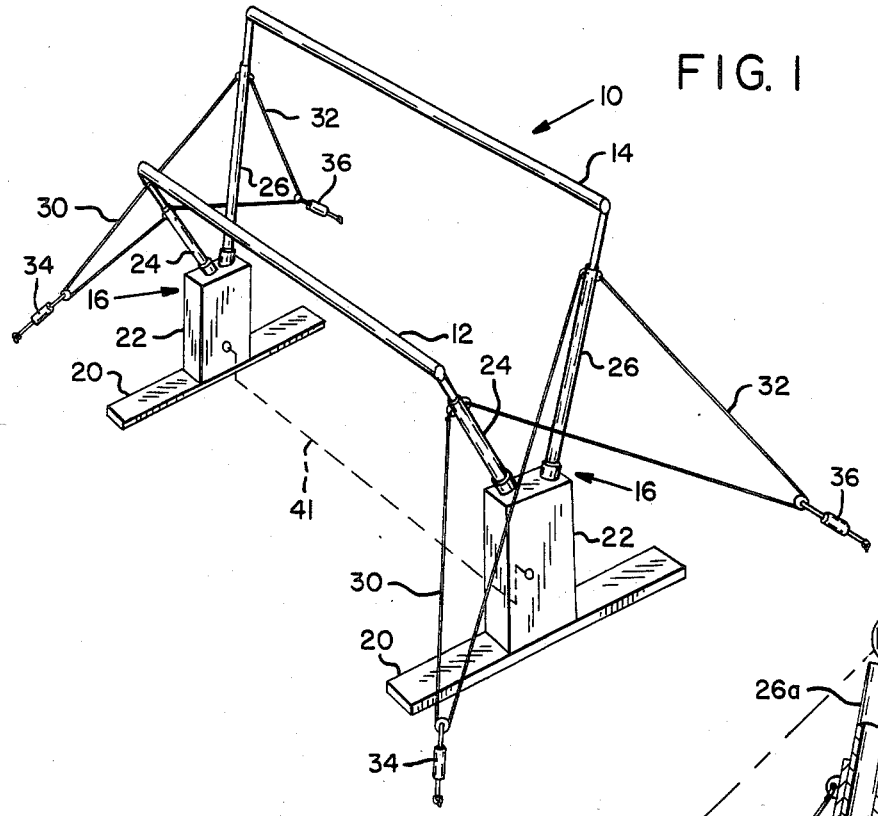
FIG. 1 is a perspective view of an exemplary embodiment of a set of uneven parallel bars constructed in accordance with the present invention.
Figure 2:
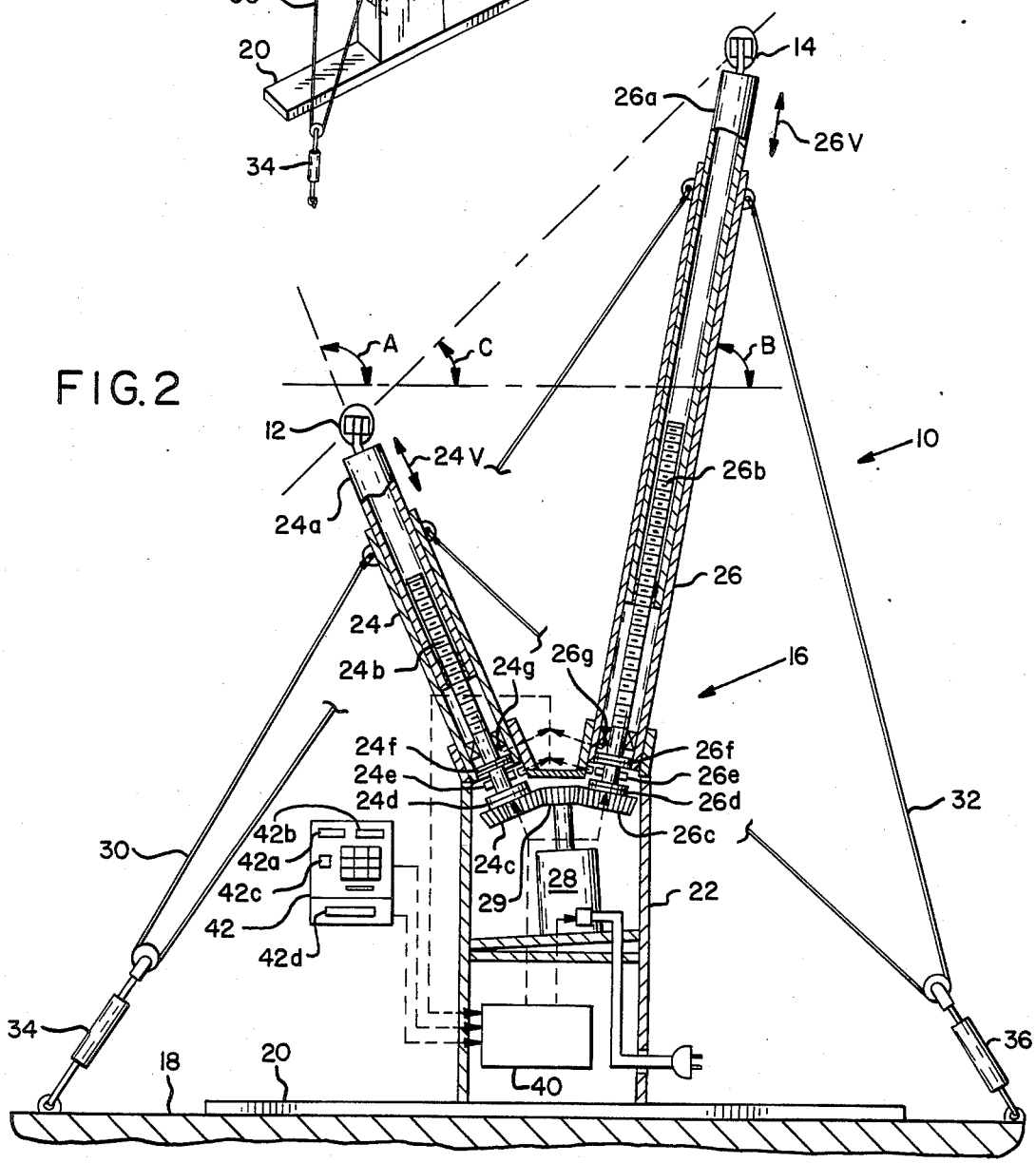
FIG. 2 is an enlarged, partially sectional and partially schematic side view of the apparatus of FIG. 1.

The set of uneven parallel bars, indicated generally as 10 in FIGS. 1 and 2, comprises a pair of elongate handrails 12 and 14 supported on each end by respective identical support assemblies 16. The support assemblies 16 hold the handrails 12 and 14 in parallel relation at respective positions spaced horizontally and vertically relative to each other and located at different vertical heights relative to a floor surface 18. Although not shown in the figures, a suitable gymnastics mat lies on the floor surface 18 in the area between the supports 16. Each support assembly 16 includes a base 20 and an upright housing 22 mounted thereon. Fixedly extending from each housing 22 are a pair of elongate, upwardly-diverging, supporting members 24 and 26 respectively of unequal length. Each supporting member 24 and 26 includes an upwardly-extending, slidable telescopic portion **24*a*, 26*a*** supporting one end of a handrail.

Each telescopic portion is selectively extensible or retractable by rotation of a respective screw member **24*b*, 26*b*, such as a ballscrew, threadably engaging its bottom end and driven by a respective bevel gear 24*c*, 26*c* which are identical. The bevel gears are driven in unison by a selectively reversible electric motor 28, either by a common drive gear 29 as shown, or by separate, axially spaced drive gears on the output shaft of the motor. Each of the bevel gears 24*c*, 26*c* drives its respective screw member through a normally-engaged, selectively-disengageable electric clutch 24***d* or 26*d*, the degree of rotation and thus the degree of extension or retraction of each of the telescopic portions 24*a* and 26*a* being sensed by a respective conventional rotation sensor 24*e*, 26*e* of the rotary encoder type measuring incremental angular distance traveled and generting pulses in response to the increments. Alternatively, a linear position transducer of any suitable type could be used. Each screw member 24*b*, 26*b* is held against rotation, when not being rotated by the motor 28, by a respective conventional brake 24*f*, 26*f*.

Respective tensioning cables 30 and 32, tensioned by turnbuckles 34 and 36, are provided on each end of the uneven bar apparatus connected between conventional floor mounting points and the stationary outer, lower portions of the supporting members 24 and 26, so as to restrain the handrails against horizontal displacement. The extension or retraction of the telescopic portions 24*a* and 26*a* require no movement or adjustment of the tension of either of the cables 30 and 32 because the cables are not attached to any movable portion of the apparatus.

Adjustment of the spacing between the handrails 12 and 14, and adjustment of the respective vertical heights of the handrails relative to the floor surface 18, occur by virtue of identical, simultaneous, motorized operation of the support assemblies 16 on each end of the handrails, each support assembly having the same adjustment mechanisms. Such adjustments, however, can be carried out in different modes, which will now be described with respect to the mechanism of one of the support assemblies, it being understood that identical actuation occurs in the other support assembly.

The simplest mode of adjustment is the simultaneous rotation of the two screw members 24*b* and 26*b* (in either direction) by the motor 28 to provide simultlaneous extension or retraction, as desired, of the telescopic portions 24*a* and 26*a*. Simultaneous extension or retraction of the telescopic portions will both change the spacing between the handrails, due to the upwardly-diverging attitudes of the support members 24 and 26, and change the respective vertical heights of the handrails relative to the floor surface 18. Such adjustments can be made precisely because feedback from the rotation sensors 24*e* and 26*e* indicates the precise degree of extension or retraction.

Such simultaneous adjustments are preferably made while maintaining the slope between the handrails 12 and 14 substantially constant. If the supporting member 24 is at a fixed angle A with respect to the horizontal, and member 26 is at a fixed angle B with respect to the horizontal, and if a slope C between the handrails is to be maintained during adjustment, it is merely necessary to extend or retract the telescopic portions 24*a* and 26*a* at different speeds to maintain the slope constant. The ratio between the speed, 24V, of extension or retraction of the portion 24*a*, and the speed, 26V, of extension or retraction of the portion 26*a*, necessary to maintain constant slope can be expressed as follows:

$$(24V/26V)=(\mathrm{Sin}(B-C)/\mathrm{Sin}(A-C)$$

To achieve such a ratio of the speeds of extension and retraction of the telescopic portions 24*a* and 26*a*, the respective pitches of the two screw members 24*b* and 26*b* are proportional to each other by the same ratio. Alternatively, the desired speed ratio can be achieved by differently pitched bevel gears or by a combination of different screw and gear pitches (different gear pitches will require a pair of drive gears such as 29 of different pitches axially spaced on the motor output shaft).

Adjustment of the handrails in the foregoing simultaneous mode of operation results in the heights of both handrails being increased simultaneously while the spacing between them increases, and vice versa on retraction. Such mode of operation also necessarily results in there being a respective different predetermined vertical height of each of the handrails relative to the floor surface for each different predetermined spacing between the handrails. Accordingly, for operation in this mode, the gymnast would merely have to specify a predetermined one of any of the three adjustments and input such adjustment to a controller for the motors 28 in a manner to be described hereafter. The other two corresponding predetermined adjustments would necessarily follow while the slope between the handrails remains constant.

On the other hand, if a gymnast requires some variation from the predetermined correspondence of the three adjustments relative to each other, such variation can be obtained by temporarily overriding the foregoing simultaneous mode of operation by selective disengagement of either one of the clutches 24*d* or 26*d*. Thus, different predetermined heights of the handrails 12 and 14, for any particular spacing between the handrails, can be obtained. For example, if a particular height of the lower handrail 12 is desired which differs from the height normally corresponding to the desired spacing of the handrails in the simultaneous mode of operation, the handrail 12 can be extended separately to the desired height while the clutch 26*d* is disengaged. Thereafter, the clutch 26*d* can be engaged while the clutch 24*d* is disengaged to extend the handrail 14 separately to whatever height is necessary to achieve the desired spacing between the handrails.

Either of the foregoing modes of operation can be effected by automatic activation and deactivation of the motors 28, control of the clutches, and control of motor direction through a microprocessor-based controller 40. The controller 40 includes a conventional comparator or differential amplifier circuit enabling it to operate in a closed loop, servo control mode in response to command signals representative of adjustment settings entered by the gymnast into an appropriate input device 42, and feedback signals from the rotary position sensors 24*e* and 26*e* indicating the actual adjustments. Depending upon the form of the settings entered by the gymnast, the microprocessor in the controller converts the setting information into command signals indicative of desired degrees of extension of the telescopic portions 24*a*, 26*a*, and continually compares the command signals to the feedback signals, operating the motors 28 to minimize deviation between the two sets of signals. The controller 40 sends control signals simultaneously to, and receives feedback signals simultaneously from, both support assemblies 16 by means of a cable 41 extending transversely beneath the aforementioned gymnastics mat. The cable 41 also carries the electrical power supply lines from one support assembly 16 to the other.

The input device 42 may simply provide for manual key entry of a predetermined single adjustment setting (for the simultlaneous mode of operation) or for two predetermined adjustment settings (for the separate mode of operation), the entered data being shown on conventional displays such as 42*a*, 42*b*. After entry of the adjustment or adjustments, actuation of a switch 42*c* causes controller 40 to actuate the motors 28 (and clutches if necessary) to effect the selected adjustments. The input device 42 can either be mounted directly on one of the support assemblies 16 ormay be remote from the apparatus. Alternative means of entry of the selected adjustments could be by magnetic card, tape or disc, or by optical bar codes, into a conventional reader unit 42*d*, thereby avoiding the need for manual key input.

To accomplish the optional secondary objective of the present invention whereby the handrail adjustments are changeable in midperformance by the gymnast, entry of sequential sets of selected adjustments are preferably through unit 42*d* for storage in a memory contained either in the input device 42 or in the controller 40. In order that the timing of such sequential, midperformance adjustments automatically coincides with the gymnast's progress through her routine, the input data preferably includes simple programming requiring at least a triggering signal indicative of the location of the gymnast at a predetermined position relative to the uneven bar apparatus as a prerequisite to each change in adjustment. Such location sensing could be by electro-optical sensors, pressure transducers indicating the weight of the gymnast on a particular handrail, or by any other suitable means.

In FIG. 2, by way of example, pressure transducers 24*g* and 26*g* can be located beneath the bearings of the respective screw members so as to detect downward pressure on the screw members resulting from the gymnast's weight on the respective handrail. The data entered in unit 42*d* for a particular gymnast would preferably require a predetermined sequence of pressure applications and releases on the transducers before effecting a particular change in adjustment. If any pressure sensings occurred out of the predetermined sequence, they would be disregarded as indicating a mishap by the gymnast.

Of course, a much simpler, but less automatic, system for changing adjustments in midperformance could simply require manual actuation of a remote switch, by a person observing the gymnast's routine, to cause the controller 40 to change the apparatus from one preselected adjustment to the next.

Although the embodiment of the invention shown in FIGS. 1 and 2 is a preferred embodiment from a point of view of belancing simplicity and economy against versatility, many other equivalent structures are intended to be within the scope of the invention, including more complex structures involving a greater number of motors or, alternatively, simpler structures requiring only a pair of motors arranged differently. Also, it is not necessary that linear electrically powered actuators be used as driving means, since electrical or fluid power actuators of either the linear or rotary type would be suitable. In fact, even manually powered driving means could be provided for making the adjustments, which would be especially useful in case of motor malfunction. For example, a hand crank (not shown) may be provided which is removably insertable, through an aperture in the top of the housing 22, into a mating socket in the upper end of the motor output shaft for manually rotating the shaft and thereby effecting the necessary adjustments.

Moreover, even though means for multiple modes of operation are disclosed herein, it may not be necessary that the apparatus have more than a single mode of operation. For example, the apparatus might be suitable for virtually all gymnasts if operated only in the above-described simultaneous mode. In such case the respective pairs of clutches 24*d*, 26*d*, rotary position sensors 24*e* and 26*e*, and brakes 24*f* and 26*f* could be replaced simply by a single brake and single rotary sensor interacting with the output shaft of each motor 28. Moreover, all brakes and rotary sensors may be subject to elimination by making each motor a permanent magnet stepper motor which moves in precise increments in response to a pulsed power supply, in which case the positions of the telescopic portions can be sensed by conventional pulse counting in an open loop arrangement, and braking can be accomplished be means of the inherent reluctance (cogging) torque of the motor.

The specific fixed diverging angles of the elongate supporting members 24 and 26 may vary depending upon the range of adjustment desired.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. Uneven parallel bars for gymnastics comprising:

(a) a pair of elongate handrails;

(b) supporting means for supporting said elongate handrails in parallel relation to each other at respective positions spaced horizontally and vertically relative to each other and located at different vertical heights relative to a floor surface, said supporting means comprising a pair of elongate, telescopically extensible and retractable, supporting members extending in fixed respective upwardly diverging directions for supporting said handrails; and (c) driving means connected to said supporting members for selectively telescopically extending and retracting said supporting members in said diverging directions and controlling the degrees of extension and retraction thereof for controllably establishing different predetermined spacings between said handrails.

2. The apparatus of claim 1 wherein said driving means includes means for selectively establishing a respective different predetermined vertical height of each of said handrails relative to said floor surface for each different predetermined spacing between said handrails.

3. The apparatus of claim 1 wherein said driving means includes means for varying the respective predetermined vertical heights of said handrails relative to said floor surface while simultaneously varying the spacings between said handrails.

4. The apparatus of claim 1 wherein said driving means includes means for increasing the respective vertical heights of both of said handrails relative to said floor surface while simultaneously increasing the spacing between said handrails.

5. The apparatus of claim 1 wherein said driving means includes means for varying the respective vertical heights of said handrails relative to said floor surface while maintaining the slope between said handrails substantially constant.

6. The apparatus of claim 1, further including tensioning cable means for restraining said handrails against horizontal displacement, said driving means including means for varying the respective vertical heights of said handrails relative to said floor surface and varying the spacing between said handrails while maintaining said cable means substantially free of movement.

7. The apparatus of claim 1 wherein said supporting means comprises two pairs of elongate, telescopically extensible, upwardly-diverging supporting members, each pair supporting a respective pair of ends of said handrails, said driving means including a pair of motors, each located adjacent a respective pair of said upwardly-diverging supporting members, each of said motors including means connecting the motor to both of the upwardly-diverging supporting members of a respective pair of supporting members for varying both the respective vertical heights of said handrails relative to said floor surface and varying the spacing between said handrails.

8. The apparatus of claim 1 wherein said driving means includes means for telescopically extending said supporting members simultaneously, each at a different speed having a predetermined ratio with respect to the speed of the other supporting member.

9. The apparatus of claim 1 wherein said supporting means comprises a base assembly for engaging said floor surface, each of said pair of upwardly-diverging supporting members having a first portion attached to said base assembly and a second portion telescopically extensible and retractible with respect to said first portion, the first portions of said upwardly-diverging supporting members being fixedly attached to said base assembly in a fixed angle of divergence with respect to each other.

10. The apparatus of claim 1, wherein said driving means comprises means for selectively telescopically extending and retracting said supporting members either in unison or, alternatively, separately from each other.

11. The apparatus of claim 1 wherein said driving means comprises a motor.

12. Uneven parallel bars for gymnastics comprising:

(a) a pair of elongate handrails;

(b) supporting means for supporting said elongate handrails in parallel relation to each other at respective positions spaced horizontally and vertically relative to each other and located at different vertical heights relative to a floor surface;

(c) tensioning cable means attached to said support means for restraining said handrails against horizontal displacement; and (d) driving means connected to said handrails for controllably establishing different predetermined spacings between said handrails by varying the spacing between said handrails while maintaining said cable means substantially free of movement.

13. The appartus of claim 12 wherein said supporting means comprises a base assembly for engaging said floor surface and a pair of elongate, telescopically extensible and retractable, upwardly-diverging supporting members extending in respective upwardly-diverging directions from said base assembly for supporting said handrails, said supporting members being fixedly attached to said base assembly in a fixed angle of divergence with respect to each other.

14. The apparatus of claim 12 wherein said driving means includes means connected to said handrails for selectively moving both of said handrails either in unison or, alternatively, separately from each other.

15. The apparatus of claim 12 wherein said driving means comprises a motor.

16. Uneven parallel bars for gymnastics comprising:

(a) a pair of elongate handrails;

(b) supporting means for supporting said elongate handrails in parallel relation to each other at respective positions spaced horizontally and vertically relative to each other and located at different vertical heights relative to a floor surface;

(c) motor means connected to said handrails for varying the spacing between said handrails;

(d) control means connected to said motor means for establishing different predetermined spacings between said handrails and controlling said motor means in response thereto, said control means including memory means for storing a plurality of different predetermined spacings and selecting therefrom in a predetermined sequence to establish said spacings; and (e) sensor means for sensing the location of a gymnast relative to said handrails, said control means being connected to said sensor means and including means for establishing said spacings in response to the location of the gymnast as sensed by said sensor means.

17. A method for operting uneven parallel bars for gymnastics, of the type comprising a pair of elongate handrails supported in parallel relation to each other at respective positions spaced horizontally and vertically relative to each other and located at different vertical heights relative to a floor surface, said method comprising varying the spacing between said handrails while a gymnast is performing on said uneven parallel bars.

* * * * *